United States Patent [19]

Passmore

[11] Patent Number: 5,003,563

[45] Date of Patent: Mar. 26, 1991

[54] ANTI-DITHER CONTAINER COUNTER

[75] Inventor: David A. Passmore, Gillett, Pa.

[73] Assignee: Emhart Industries, Inc., Towson, Md.

[21] Appl. No.: 391,867

[22] Filed: Aug. 10, 1989

[51] Int. Cl.[5] ..... G06M 7/00

[52] U.S. Cl. ..... 377/6; 250/223 B; 377/53

[58] Field of Search ..... 377/6, 53; 250/223 B

[56] References Cited

U.S. PATENT DOCUMENTS

| | | | |
|---|---|---|---|
| 3,665,444 | 5/1972 | Scott | 377/6 |
| 3,955,179 | 5/1976 | Planke | 377/13 |
| 4,000,400 | 12/1976 | Elder | 377/6 |
| 4,081,661 | 3/1978 | Durbin | 377/6 |
| 4,831,638 | 5/1989 | Dabby et al. | 377/6 |

FOREIGN PATENT DOCUMENTS

| | | | |
|---|---|---|---|
| 0123186 | 5/1988 | Japan | 377/6 |

*Primary Examiner*—John S. Heyman
*Attorney, Agent, or Firm*—Spencer T. Smith

[57] ABSTRACT

A first sensor at a first location along a conveyor provides a first signal indicating whether or not a container is present at the first location while a second sensor similarly provides a second signal indicating whether or not a container is present at a second nearby location. The first and second signals are input to a logic circuit which outputs a count pulse only if the the inputs are of a proper form in a proper sequence designed so that dither is ignored. The sensors are diffuse reflection type sensors operating at different frequencies. They are mounted so their sensing axes converge at about a 15 degree angle and the sensor lenses are about 3.5 inches from the point of conveyance. A mounting system allows the sensors to be moved up/down and in/out with respect to the conveyor and maintain a position perpendicular with both the container sidewall and the container flow direction.

6 Claims, 3 Drawing Sheets

TRUTH TABLE FOR LOGIC CIRCUIT
NO DITHER

| | A | B | C (OUTPUT) |
|---|---|---|---|
| FIG. 3 | 1 | 1 | 0 |
| FIG. 4 | ⟍ | 1 | 0 |
| FIG. 5 | 0 | ⟍ | ⊓ |
| FIG. 6 | ⟋ | 0 | 0 |
| FIG. 7 | 1 | ⟋ | 0 |

TRUTH TABLE FOR LOGIC CIRCUIT
WITH DITHER

| | A | B | C (OUTPUT) |
|---|---|---|---|
| FIG. 3 | 1 | 1 | 0 |
| FIG. 4 | ⟍ | 1 | 0 |
| DITHER BY LEADING EDGE | ⟋ | 1 | 0 |
| | ⟍ | 1 | 0 |
| FIG. 5 | 0 | ⟍ | ⊓ |
| | 0 | ⟋ | 0 |
| DITHER BY LEADING EDGE AFTER COUNTED | ⟋ | 1 | 0 |
| | ⟍ | 1 | 0 |
| | 0 | ⟍ | 0 |
| FIG.6 | ⟋ | 0 | 0 |
| DITHER BY TRAILING EDGE ON SENSOR A | ⟍ | 0 | 0 |
| | ⟋ | 0 | 0 |
| FIG. 7 | 1 | ⟋ | 0 |
| DITHER BY TRAILING EDGE ON SENSOR B | 1 | ⟍ | 0 |
| | 1 | ⟋ | 0 |

ANTI-DITHER CONTAINER COUNTER

BACKGROUND OF THE INVENTION

1. Field of the Invention

The invention, in general, relates to devices for counting containers, such as glass bottles, and more particularly, a counter that provides an accurate count of containers even when containers dither on their conveyor.

2. Description of the Prior Art

Accurate, non-contact counting of containers is essential in many industrial applications. For example, in the glass container industry production analyzing systems require accurate infeed and outfeed container counts to generate precise reports of container losses on various inspection and container handling devices along the production line. Dither has always presented a difficult problem for such counters. Dither occurs when the flow of containers is impeded and the conveyor continues to run. There are a myriad of reasons for this condition to take place: inspection equipment jams, flow control devices, conveyor jams, etc. Another common occurrence of container dither is caused by inspection and container handling devices that incorporate infeed screws. As the infeed screw rotates to feed containers into the equipment, pulsations are introduced back into the containers upstream of the device. Up to now, all counting systems, including those based on sonic, through beam, diffuse reflection, triple beam and retro-reflective sensors have produced multiple "counts" for a single container when the container dithers on the sensing edge of the container counting device. In the prior art, a technique called blanking has been used to attempt to solve this problem. In this technique, the counter is blanked for a predetermined short time period after each count. However, systems that incorporate blanking do not work well, as they are sensitive to the normal line speed variation which occurs continuously in bottle handling systems. Thus it would be highly desirable to provide a container counter that does not produce multiple counts when containers dither.

SUMMARY OF THE INVENTION

It is an object of the invention to provide a container counter that is highly accurate even when the containers dither.

It is a further object of the invention to provide the above object in a container counter that is not sensitive to line speed variation.

It is a further object of the invention to provide one or more of the above objects in a container counter that is highly reliable.

It is another object of the invention to provide one or more of the above objects in a container counter that can be used with containers of a wide variety of shapes and sizes and made of a variety of materials.

The invention provides a container counting apparatus for counting containers being conveyed on a means for conveying, said counter comprising: first sensor means for sensing the presence of a container at a first location and for providing a first signal representative of whether the container is present at said first location; second sensor means for sensing the presence of said container at a second location and for providing a second signal representative of whether the container is present at said second location; and logic means responsive to said first and second signals for providing a container counted signal for each container that passes by said first and second locations and for preventing additional bottle counted signals when a container dithers on said means for conveying. Preferably, the logic means comprises means for preventing additional bottle counted signals when a container dithers at said first location, said second location or in between said first and second locations. Preferably, said first sensor means senses along a first sensing axis and said second sensor means senses along a second sensing axis, and said first and second axes converge at an angle of substantially 15°. Preferably, said first sensor means comprises means for producing and detecting radiation of a first frequency and said second sensor means comprises means for producing and detecting radiation of a second frequency different from said first frequency. Preferably, said containers are glass bottles.

The invention not only provides a container counter that is not affected by dither, but also provides one that is relatively easy to set up, operate and maintain. Numerous other features, objects and advantages of the invention will become apparent from the following detailed description when read in conjunction with the accompanying drawings.

DESCRIPTION OF THE PREFERRED EMBODIMENT

Figure 1:
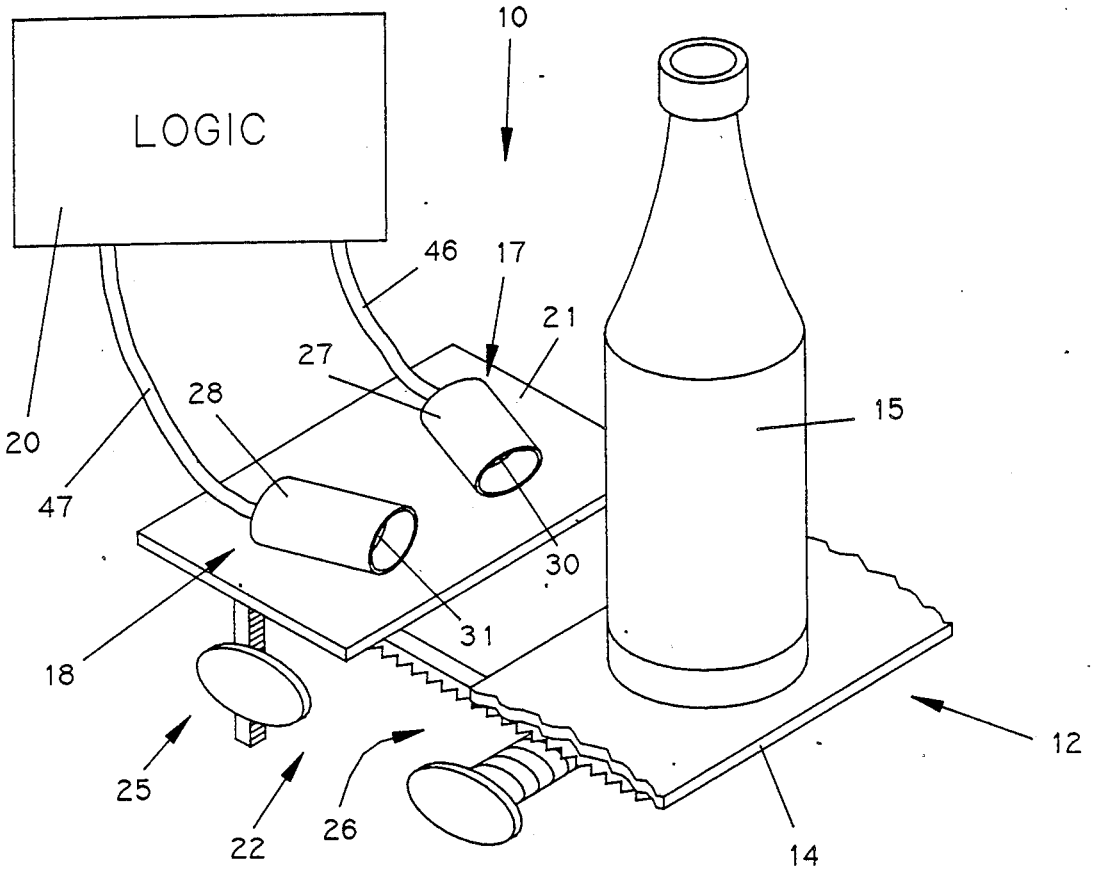
FIG. 1 is a perspective diagrammatic view of a bottle on a conveyor and showing the various components of the invention.
Figure 3:
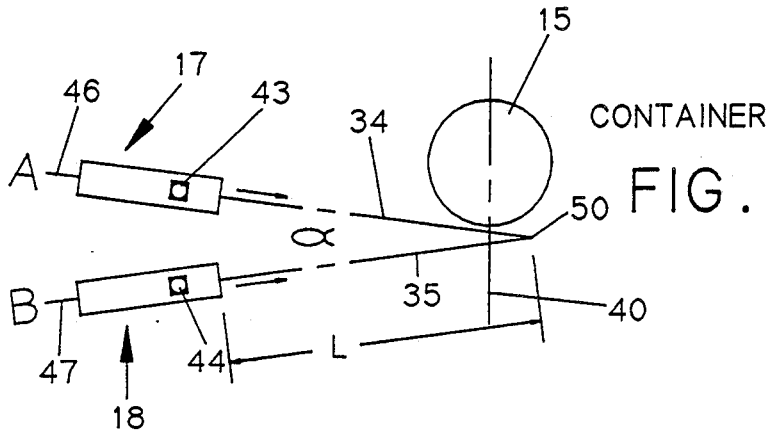
FIGS. 3 through 7 are top diagrammatic views showing a bottle at various points along a path passing the first and second sensing means.
Figure 4:
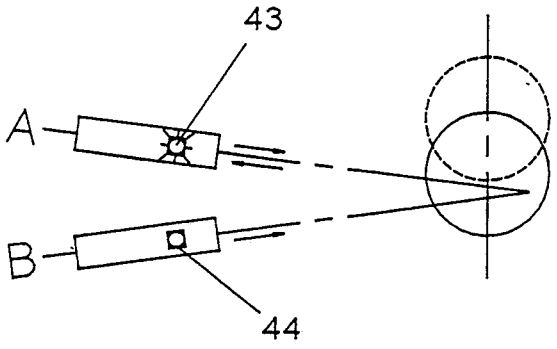
Figure 5:
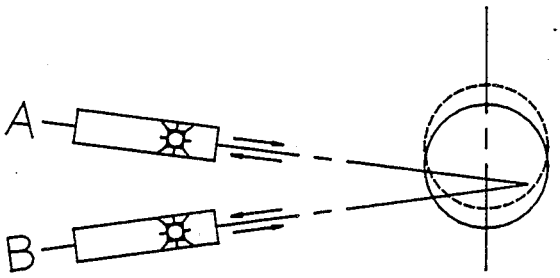
Figure 6:
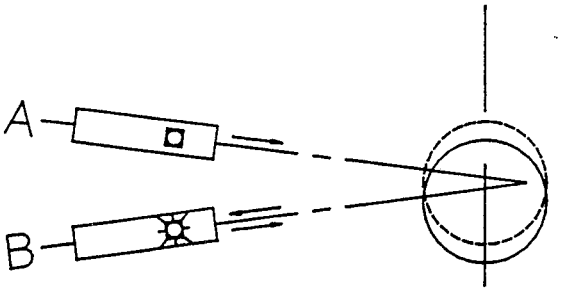

Directing attention to FIG. 1, a perspective diagrammatic view of the apparatus 10 of the invention being employed in conjunction with a glass bottle conveyor 12. It should be understood that the particular embodiment of the invention shown in FIG. 1 and the other FIGS. is intended to be exemplary only, is shown only to illustrate the invention, and is not intended to limit the invention to the particular details of the embodiment. The conveyor comprises a conveyor belt 14 and conventional structure supporting and driving it, which structure is not shown for clarity. A bottle 15 is conveyed by the conveyor 12 past the counter 10 of the invention. Counter 10 comprises a first sensing means 17, second sensing means 18, logic means 20, a support 21, and a mounting means 22 for adjustably mounting the support 21 and sensing means 17 and 18 on the conveyor 12. The means 22 comprises a means 25 for vertically adjusting the height of the sensing means 17 and 18 with respect to the conveyor and a means 26 for adjusting the distance of the sensing means 17 and 18 to the conveyor. The mounting means 22 is attached to the conveyor support structure which is not shown. The invention also may include means for individually adjusting the position, including the angle with the perpendicular to the line of bottle motion, of each of the sensors 17 and 18. The mounting means 22 permits the sensors 17 and 18 to move up and down and in and out with respect to the conveyor 12 and at the same time maintain a position perpendicular both with the container sidewall and the container flow direction 40 (FIG. 3). Since the sidewall of the preferred container, a glass bottle 15, is curved and the sensors 17 and 18 are spaced apart they must be at an angle to one another if each is to be perpendicular to the container sidewall.

In the preferred embodiment, each of the sensor means 17 and 18 is a diffuse reflection type sensor, each operating at a different frequency. The preferred embodiment sensor means is a Keyence Model PZ-41 available from Keyence Corporation of America, 20610 Manhattan Place, Suite 132, Torrence, CA 90501. Each sensor 17 and 18 has a light source and a light detector enclosed within a casing 27 and 28 respectively, and a lens 30 and 31 respectively. The positioning of the sensors 17 and 18 with respect to one another and the bottle 15 is seen better in FIGS. 3 through 7. Referring to FIG. 3, first sensor means 17 senses along a first sensing axis 34, second sensor means 18 senses along a second sensing axis 35. It has been found that optimum results are obtained if the axis 34 and axis 35 converge at an angle of 15° and the lenses 30 and 31 are located a length L, 3.5 inches from the point 50 of convergence. Preferably, the convergence point is beyond the center line of the container. These dimensions permit a wide range of container diameters. It is understood that these dimensions can vary however. As shown in FIGS. 3 through 7, each of the sensor means 17 and 18 include an LED, 43 and 44 respectively, which indicates when the sensor is sensing the presence of a container.

Figure 2:
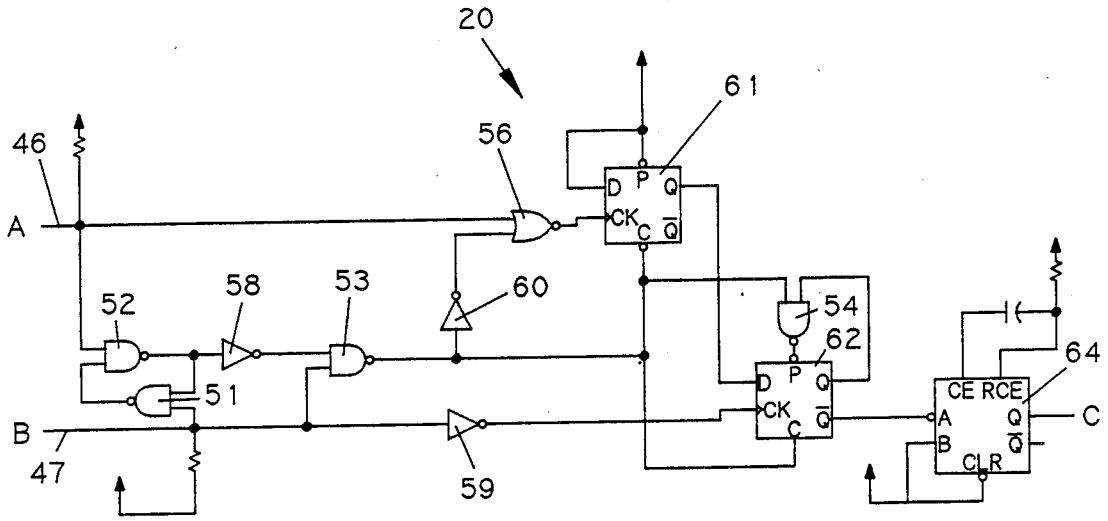
FIG. 2 is an electrical circuit diagram of the logic means of the invention.

Sensor means 17 is connected to logic means 20 via electrical cable 46 while sensor means 18 is connected to logic means 20 via electrical cable 47. The logic means 20 is preferably an electrical circuit as shown in FIG. 2. The circuit preferably comprises NAND gates 51 through 54, NOR gate 56, inverters 58 through 60, flip-flops 61 and 62, and one-shot 64. The inputs are labeled A and B while the output is labeled C.

The counter according to the invention operates as follows. The sensor means support 21 is positioned to be perpendicular to both the container sidewall and the container flow direction 40, which is from top to bottom in FIGS. 3 through 7. The support 21 is adjusted in the in/out direction via the adjusting means 26 so that the following sequence of sensor means 17 and 18 activity occurs when a container traverses the sensor means arrangement: The upstream sensor means 17, hereinafter and in FIGS. 3 through 9 referred to as sensor A so as to correspond to the input A of FIG. 2, detects the container, followed by detection by the downstream sensor means 18, hereinafter and in FIGS. 3 through 9 referred to as sensor B. Next sensor A detects the absence of a container followed by sensor B detecting the absence of a container. For this sequence to be correct, the convergence point must be beyond the center line of the container. Note that the in/out adjustment of support 21 does not change the length L. This activity causes the logic means 20 to produce one count pulse on output C and reset itself in preparation for the next container. As will be shown in detail below, the logic means circuit 20 is designed to ignore leading and trailing edge dither on both sensors A and B. By design, no adjustment is necessary for container flow speed variation.

Figures 7, 8, 9:
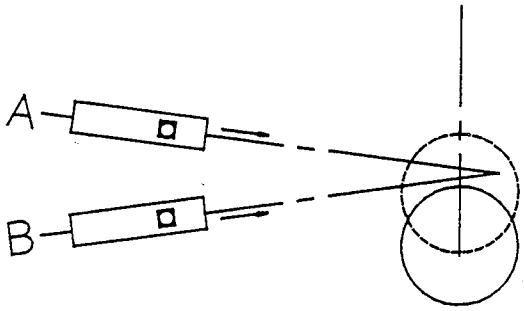
FIG. 8 shows the truth table for the logic circuit of FIG. 2 with no dither for a bottle at the various points shown in FIGS. 3 through 7.
FIG. 9 shows the truth table for the logic circuit of FIG. 2 for a bottle dithering at certain points shown in FIGS. 3 through 7.

FIGS. 3 through 7 and the truth tables in FIGS. 8 and 9 further illustrate the invention. In each of the FIGS. 3 through 7, the output of the sensors A and B are indicated by the status of the LED's 43 and 44. For example in FIG. 4, LED 43 is on indicating sensor A has changed to a "low" or "logic 0" signal indicating it is detecting the presence of a bottle, while LED 44 is off indicating that sensor B is inputting to the logic means 20 a "high" or "logic 1" signal indicating it is detecting the absence of a bottle. In the truth table of FIG. 8, the signals on inputs A and B and output C of logic circuit 20 are summarized for each of the FIGS. 3 through 7. The signals are shown as a logic 1, logic 0, in transition from low to high (logic 0 to logic 1) as for example the entry under column A for FIG. 6, in transition from high to low (logic 1 to logic 0) as in the entry under column A for FIG. 4, or as a one-shot pulse, as the entry under column C for FIG. 5. In FIGS. 3 through 7, the solid "container" lines represent present container position while the dashed "container" lines represent the container's previous position. For example, in FIG. 4, the container has just moved from the dashed position to the solid position. FIG. 8 illustrates the truth table for the situation where the container 15 passes smoothly from a position upstream of both sensors A and B to a position downstream of both sensors with no dither.

FIG. 9 shows the output of the logic circuit 20 in the cases where there is dither at the leading and trailing edges for each sensor. The entries for FIGS. 3 through 7 given in FIG. 8 are also included for reference. For each row, an analysis of the response of the circuit components 51 through 54, 56, 58, 59, 60, 61, 62 and 64 of FIG. 2 to the A and B inputs shown, gives the output shown in column C. It is seen that the logic circuit 20 generates a count pulse only when its A and B inputs receive high to low and low to high transitions in the proper sequence. Thus it is seen that in all cases the dither is ignored by the circuit. In all cases, the one-shot produces only one pulse indicating one count. Thus the invention counts each container 15 once and only once.

A novel apparatus for counting containers that accurately counts containers even in the presence of dither has been described. It is evident that those skilled in the art may now make numerous uses and modifications of and departures from the specific embodiment described herein without departing from the inventive concepts. For example, the various electronic components can be replaced with equivalent electronic parts. The mechanical parts may be made differently to perform equivalent functions. Many other variations may be described. Consequently, the invention is to be construed as embracing each and every novel feature and novel combination of features present and/or possessed by the container counter described.

What is claimed is:

1. An apparatus for counting glass bottle containers being conveyed on a conveyor comprising a first sensor including a light source operating at a first frequency and a light detector which senses light along a selected first axis, a second sensor including a light source operating at a second frequency and a light detector which senses light along a selected second axis, means for mounting said first and second sensors so that said first sensing axis and said second sensing axis converges at a point beyond the centerline of the glass bottle containers, the angle of convergence being predetermined so that each sensor can sense the presence of the same glass bottle container without the glass bottle container being senses by the other sensor and so that both sensors can sense the same glass bottle container at the same time.

2. Apparatus as in claim 1 wherein said logic means comprises means for preventing additional bottle counted signals when a container dithers at said first location, said second location, or in between said first and second locations.

3. Apparatus as in claim 1 wherein the movement of said container along said conveyor defines a leading edge and a trailing edge of said container and wherein said logic means comprises means for preventing additional bottle counted signals when a container dithers with either said leading edge or said trailing edge at either said first or second locations.

4. Apparatus as in claim 1 wherein said first sensor means senses along a first sensing axis and said second sensor means senses along a second sensing axis and wherein said first and second axes converge at an angle of substantially 15°.

5. Apparatus as in claim 1 wherein said first and second sensing means are each substantially 3.5 or more inches from the point of convergence of said first and second axes.

6. Apparatus as in claim 1 wherein said first and second sensing means each comprise a diffuse reflection type sensor.

* * * * *